US010866549B2

(12) United States Patent
Kohama et al.

(10) Patent No.: US 10,866,549 B2
(45) Date of Patent: Dec. 15, 2020

(54) FIXING DEVICE CAPABLE OF RESTRICTING ELECTRIC CONNECTION STATE FROM BECOMING UNSTABLE, IMAGE FORMING APPARATUS

(71) Applicant: KYOCERA Document Solutions Inc., Osaka (JP)

(72) Inventors: Atsushi Kohama, Osaka (JP); Takashi Eiki, Osaka (JP); Yuhiro Sakai, Osaka (JP); Hiroki Kawasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/774,944

(22) Filed: Jan. 28, 2020

(65) Prior Publication Data

US 2020/0241456 A1 Jul. 30, 2020

(30) Foreign Application Priority Data

Jan. 29, 2019 (JP) ..... 2019-012799

(51) Int. Cl.
*G03G 15/20* (2006.01)
*G03G 15/00* (2006.01)

(52) U.S. Cl.
CPC ..... *G03G 15/2053* (2013.01); *G03G 15/80* (2013.01)

(58) Field of Classification Search
CPC ..... G03G 15/20; G03G 15/2053; G03G 15/2064; G03G 15/80; G03G 2215/2035; G03G 2221/1654
USPC ..... 399/107, 110, 122, 320, 328, 329
See application file for complete search history.

(56) References Cited

U.S. PATENT DOCUMENTS 9,031,447 B2 * 5/2015 Tanaka ..... G03G 15/2042 399/90
9,952,541 B2 * 4/2018 Lee ..... G03G 15/2053

FOREIGN PATENT DOCUMENTS

JP 2000113931 A 4/2000

* cited by examiner

*Primary Examiner* — Hoan H Tran
(74) *Attorney, Agent, or Firm* — Alleman Hall Creasman & Tuttle LLP

(57) ABSTRACT

A fixing device includes a fixing belt, a heating portion, and a belt guide member. The heating portion heats the fixing belt. The belt guide member includes a guide portion and an engaging portion. The guide portion guides the fixing belt to move along a moving path. The engaging portion is provided to project from the guide portion outward in a width direction of the fixing belt, wherein the engaging portion is engaged with a connector at an engagement position that intersects with a plane that includes a center, in the width direction, of the connector attached to the heating portion in an attachment direction perpendicular to the width direction.

9 Claims, 9 Drawing Sheets

FIXING DEVICE CAPABLE OF RESTRICTING ELECTRIC CONNECTION STATE FROM BECOMING UNSTABLE, IMAGE FORMING APPARATUS

INCORPORATION BY REFERENCE

This application is based upon and claims the benefit of priority from the corresponding Japanese Patent Application No. 2019-012799 filed on Jan. 29, 2019, the entire contents of which are incorporated herein by reference.

BACKGROUND

The present disclosure relates to an electrophotographic image forming apparatus and to a fixing device provided in the image forming apparatus.

An electrophotographic image forming apparatus includes a fixing device that heats a sheet to which a toner image has been transferred, to fix the toner image to the sheet. The fixing device includes a fixing belt, a heating portion, and a guide portion. The heating portion heats the fixing belt. The guide portion guides the fixing belt to move along the moving path. In this type of fixing device, a connector that electrically connects the heating portion with cables connected to a power supply may be attached to the heating portion in an attachment direction perpendicular to a width direction of the fixing belt.

SUMMARY

A fixing device according to an aspect of the present disclosure includes a fixing belt, a heating portion, and a belt guide member. The heating portion heats the fixing belt. The belt guide member includes a guide portion and an engaging portion. The guide portion guides the fixing belt to move along a moving path. The engaging portion is provided to project from the guide portion outward in a width direction of the fixing belt, wherein the engaging portion is engaged with a connector at an engagement position that intersects with a plane that includes a center, in the width direction, of the connector attached to the heating portion in an attachment direction perpendicular to the width direction.

An image forming apparatus according to another aspect of the present disclosure forms an image on a sheet by using the fixing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Configuration of Image Forming Apparatus 100

Figure 1:
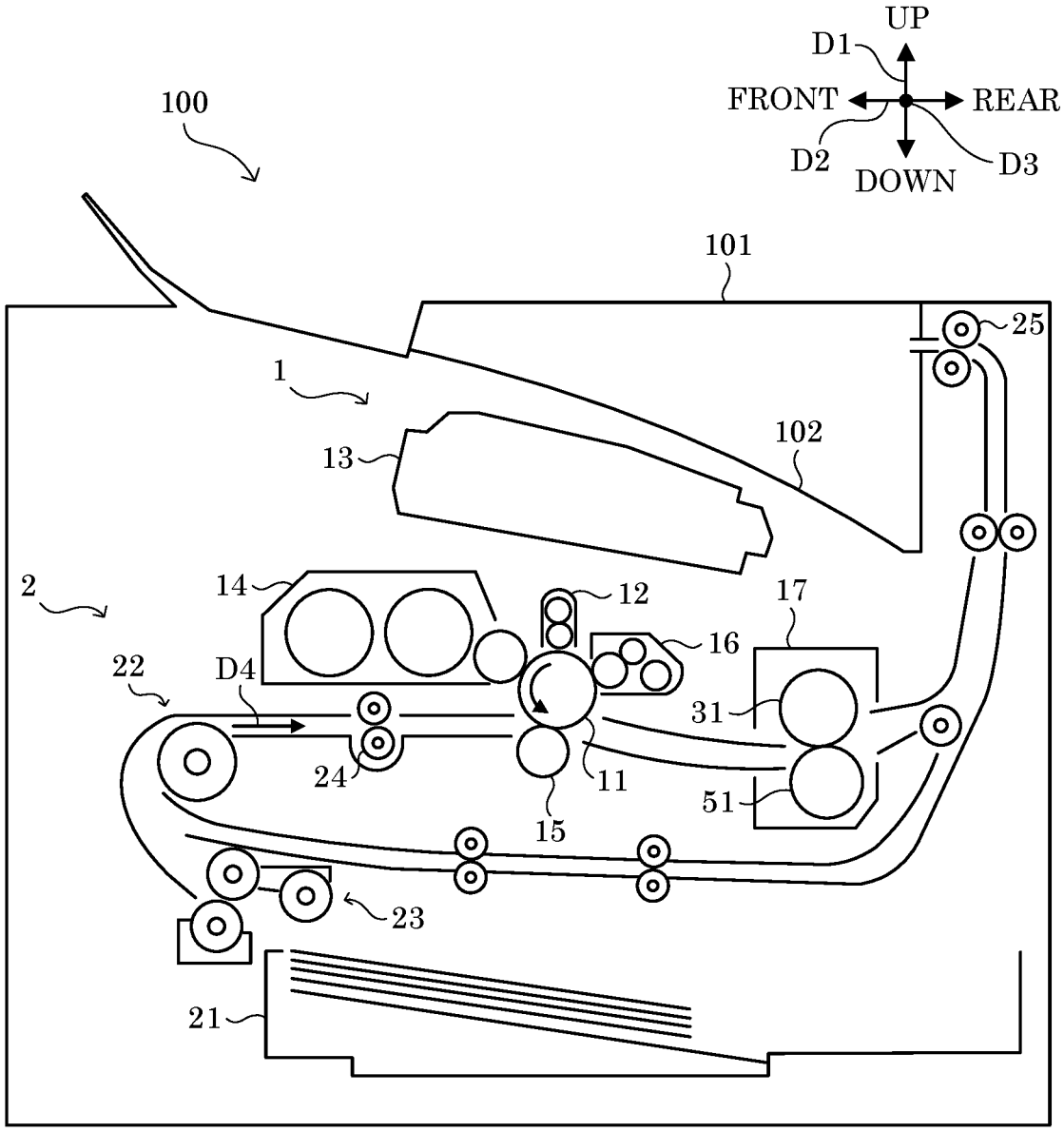
FIG. 1 is a diagram showing a configuration of image forming apparatus.

First, a description is given of a configuration of an image forming apparatus 100 according to an embodiment of the present disclosure with reference to FIG. 1. Here, FIG. 1 is a cross-sectional diagram showing a configuration of the image forming apparatus 100.

For the sake of explanation, an up-down direction D1 is defined as a vertical direction in a state where the image forming apparatus 100 is installed usably (the state shown in FIG. 1). In addition, a front-rear direction D2 is defined on the supposition that the left-side surface of the image forming apparatus 100 shown in FIG. 1 is a front side (front). Furthermore, a left-right direction D3 is defined based on the image forming apparatus 100 in the installation state viewed from the front side.

The image forming apparatus 100 is a printer having a print function to form an image based on image data. It is noted that the present disclosure is applicable to image forming apparatuses such as a facsimile apparatus, a copier, and a multifunction peripheral.

As shown in FIG. 1, the image forming apparatus 100 includes an image forming portion 1 and a sheet conveying portion 2. The image forming portion 1 and the sheet conveying portion 2 are stored in a housing 101 of the image forming apparatus 100. The housing 101 is formed in an approximate shape of a rectangular parallelepiped. A sheet receiving portion 102 is formed in an upper portion of the housing 101, wherein a sheet with an image formed thereon by the image forming apparatus 100 is discharged to the sheet receiving portion 102.

The image forming portion 1 is configured to form an image by an electrophotographic method based on image data input from an external information processing apparatus such as a personal computer. As shown in FIG. 1, the image forming portion 1 includes a photoconductor drum 11, a charging device 12, a laser scanning unit 13, a developing device 14, a transfer roller 15, a cleaning device 16, and a fixing device 17.

The photoconductor drum 11 is rotatably supported by the housing 101. Upon receiving a rotational driving force transmitted from a motor (not shown), the photoconductor drum 11 rotates in a direction indicated by an arrow in FIG. 1. An electrostatic latent image is formed on the surface of the photoconductor drum 11.

The charging device 12 charges the surface of the photoconductor drum 11.

The laser scanning unit 13 irradiates light based on image data onto the charged surface of the photoconductor drum 11. The electrostatic latent image is formed on the surface of the photoconductor drum 11 by the laser scanning unit 13.

The developing device 14 develops, by using developer including toner, the electrostatic latent image formed on the surface of the photoconductor drum 11. The developing device 14 forms a toner image on the surface of the photoconductor drum 11.

The transfer roller 15 transfers the toner image formed on the surface of the photoconductor drum 11 to a sheet conveyed by the sheet conveying portion 2.

The cleaning device 16 cleans the surface of the photoconductor drum 11 after the toner image is transferred therefrom by the transfer roller 15.

The fixing device 17 heats the sheet to which the toner image has been transferred, thereby fixing the toner image to the sheet. Here, the fixing device 17 is any one of fixing devices 17A, 17B, 17C, and 17X that are described below.

The sheet conveying portion 2 conveys a sheet on which an image is formed by the image forming portion 1. As shown in FIG. 1, the sheet conveying portion 2 includes a sheet feed cassette 21, a sheet conveyance path 22, a sheet feed unit 23, a pair of registration rollers 24, and a pair of discharge rollers 25.

The sheet feed cassette 21 stores sheets on which images are formed by the image forming portion 1. As shown in FIG. 1, the sheet feed cassette 21 is provided in a bottom portion of the housing 101. For example, the sheets stored in the sheet feed cassette 21 are sheet-like materials such as sheets of paper, sheets of coated paper, postcards, envelopes, and OHP sheets. The sheet feed cassette 21 includes a lift plate (not shown) for lifting a plurality of sheets stored therein.

The sheet conveyance path 22 is a path in which a sheet moves from the sheet feed cassette 21 to the sheet receiving portion 102 via the transfer roller 15 and the fixing device 17. A plurality of pairs of rollers, including the pair of registration rollers 24 and the pair of discharge rollers 25, are provided in the sheet conveyance path 22. In the sheet conveyance path 22, a sheet fed from the sheet feed cassette 21 by the plurality of pairs of rollers is conveyed in a conveyance direction D4 (see FIG. 1) toward the sheet receiving portion 102. The sheet conveyance path 22 is formed by a pair of conveyance guide members provided in the housing 101.

The sheet feed unit 23 feeds the sheets stored in the sheet feed cassette 21 one by one to the sheet conveyance path 22. The sheet feed unit 23 includes a pickup roller, a sheet feed roller, and a retard roller. The pickup roller feeds a top sheet among the plurality of sheets lifted by the lift plate of the sheet feed cassette 21, to the sheet feed roller by rotating while in contact with an upper surface of the top sheet. The sheet feed roller feeds the sheet fed by the pickup roller to the sheet conveyance path 22 by rotating while in contact with the upper surface of the sheet. The retard roller is disposed below the sheet feed roller and biased toward the sheet feed roller. When a plurality of overlapping sheets are fed by the pickup roller, the retard roller separates sheets other than the top sheet from the plurality of overlapping sheets.

The pair of registration rollers 24 convey the sheet such that the sheet reaches a transfer position at the same timing when a toner image formed on the surface of the photoconductor drum 11 and carried by its rotation reaches the transfer position such that the toner image is transferred to the sheet by the transfer roller 15 at the transfer position.

The pair of discharge rollers 25 discharge the sheet to which the toner image has been fixed by the fixing device 17, to the sheet receiving portion 102.

First Embodiment

Figure 2:
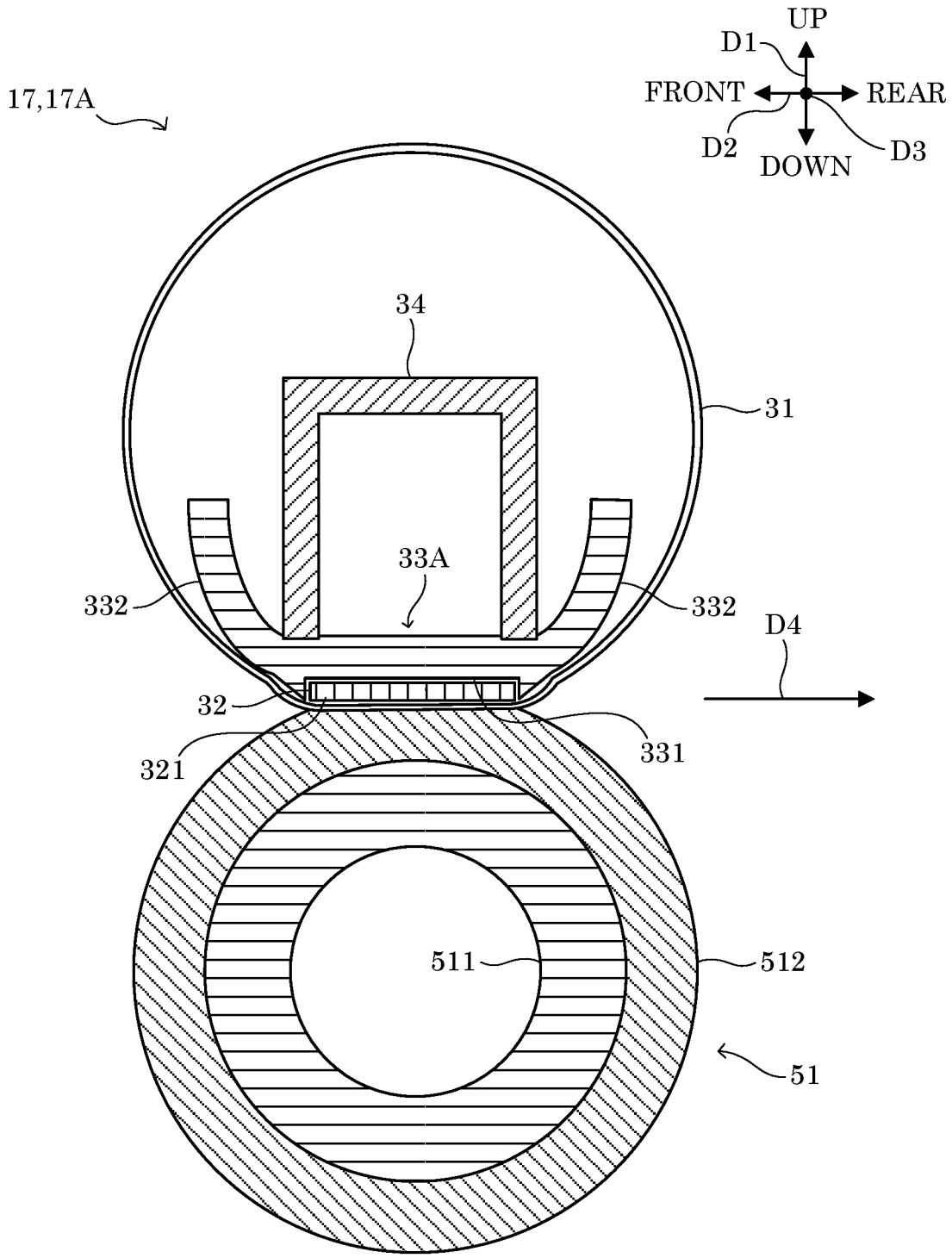
FIG. 2 is a diagram showing a configuration of a fixing device according to a first embodiment of the present disclosure.
Figure 3:
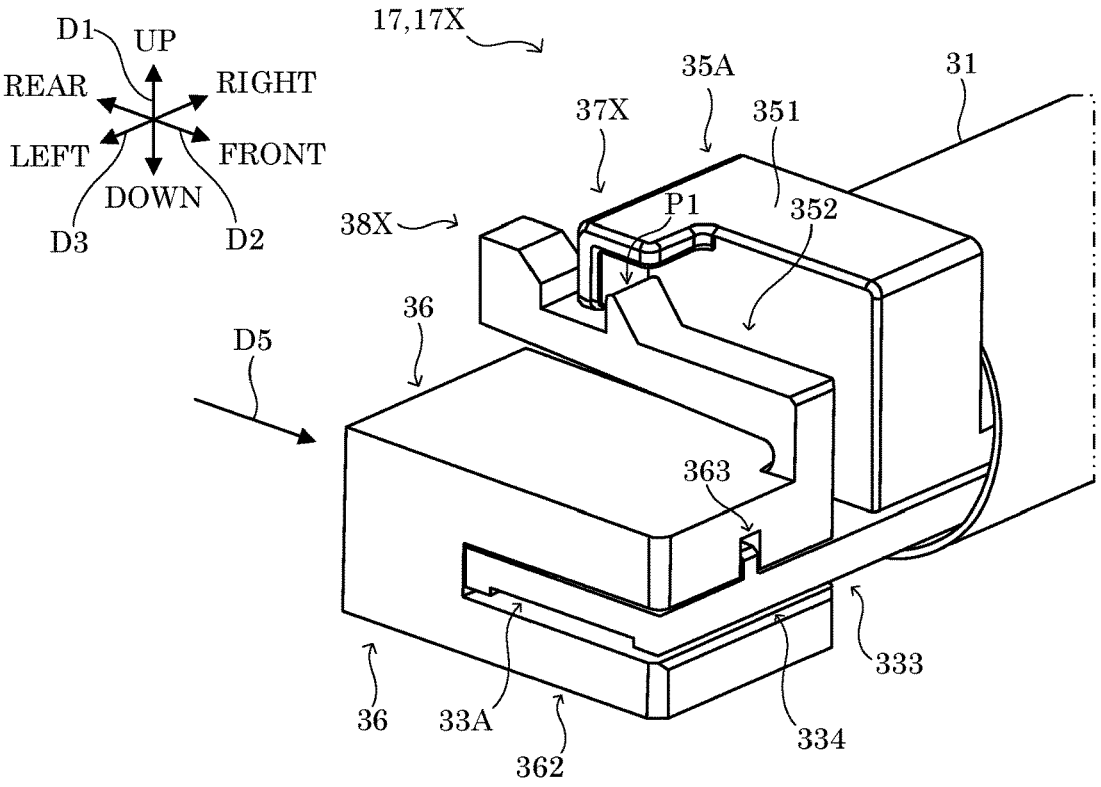
FIG. 3 is a diagram showing a configuration of a fixing device that does not belong to embodiments of the present disclosure.
Figure 4:
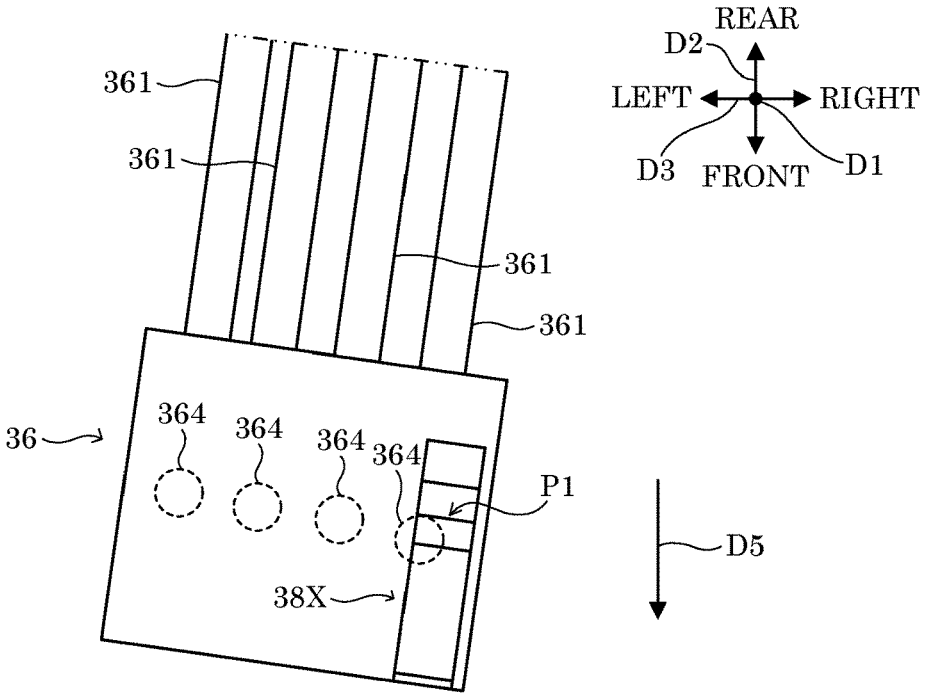
FIG. 4 is a diagram showing a configuration of a connector of the fixing device that does not belong to the embodiments of the present disclosure.
Figure 5:
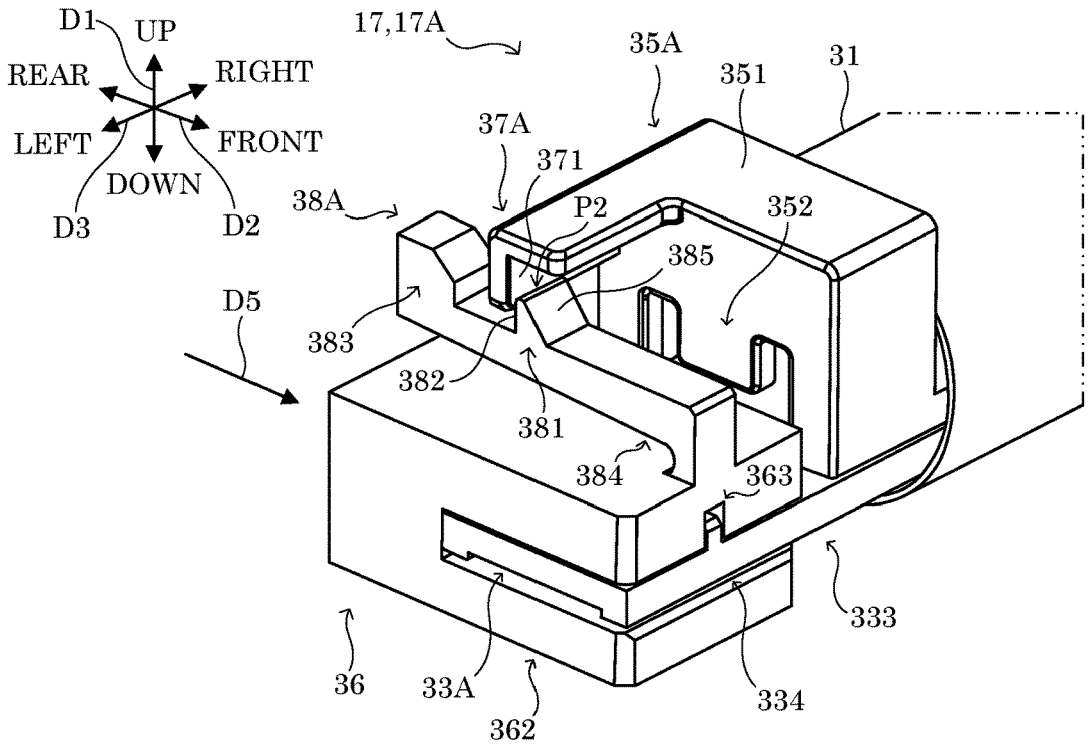
FIG. 5 is a diagram showing a configuration of the fixing device according to the first embodiment of the present disclosure.
Figure 6:
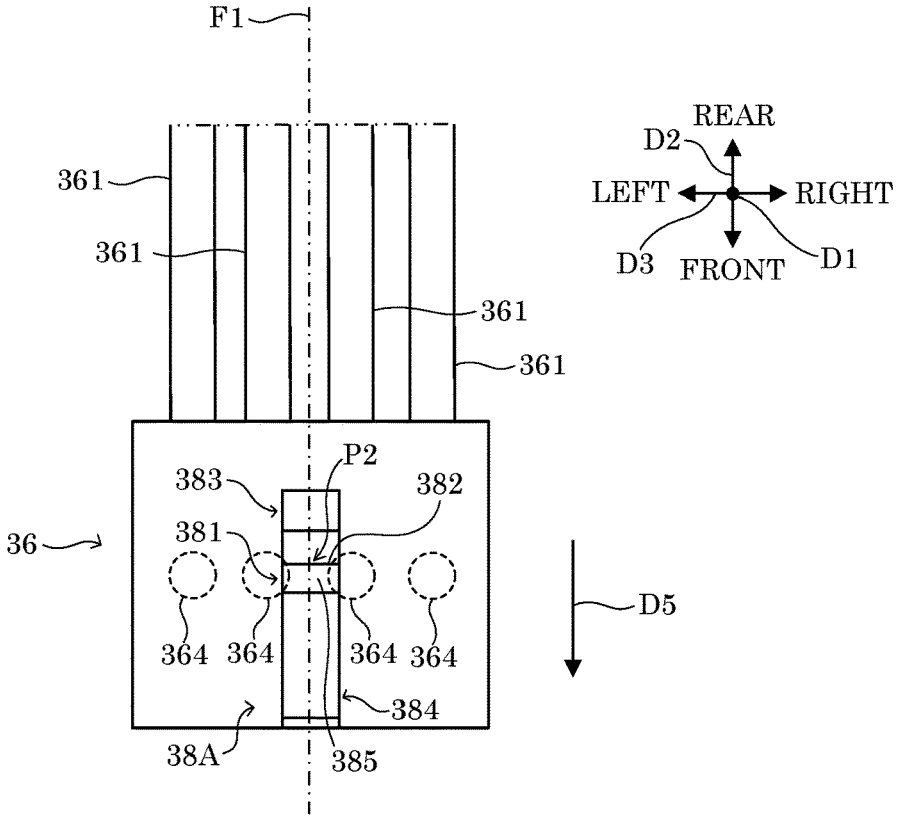
FIG. 6 is a diagram showing a configuration of a connector of the fixing device according to the first embodiment of the present disclosure.
Figure 7:
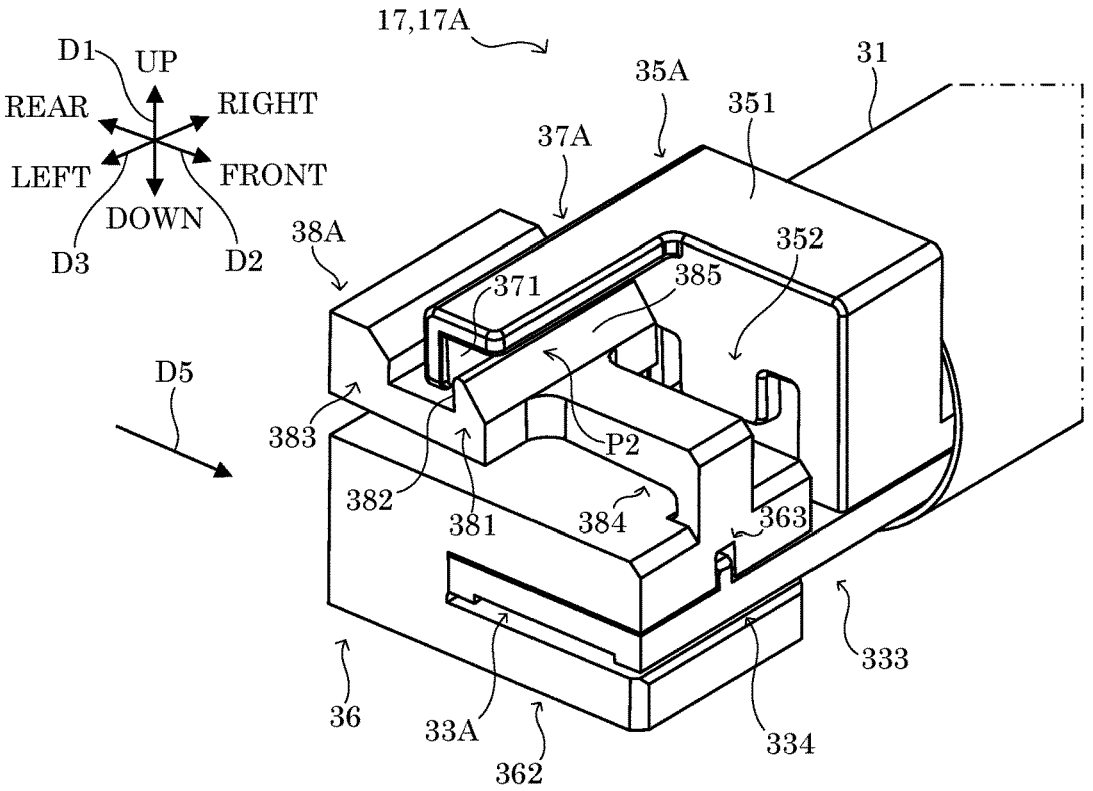
FIG. 7 is a diagram showing a modification of the fixing device according to the first embodiment of the present disclosure.
Figure 8:
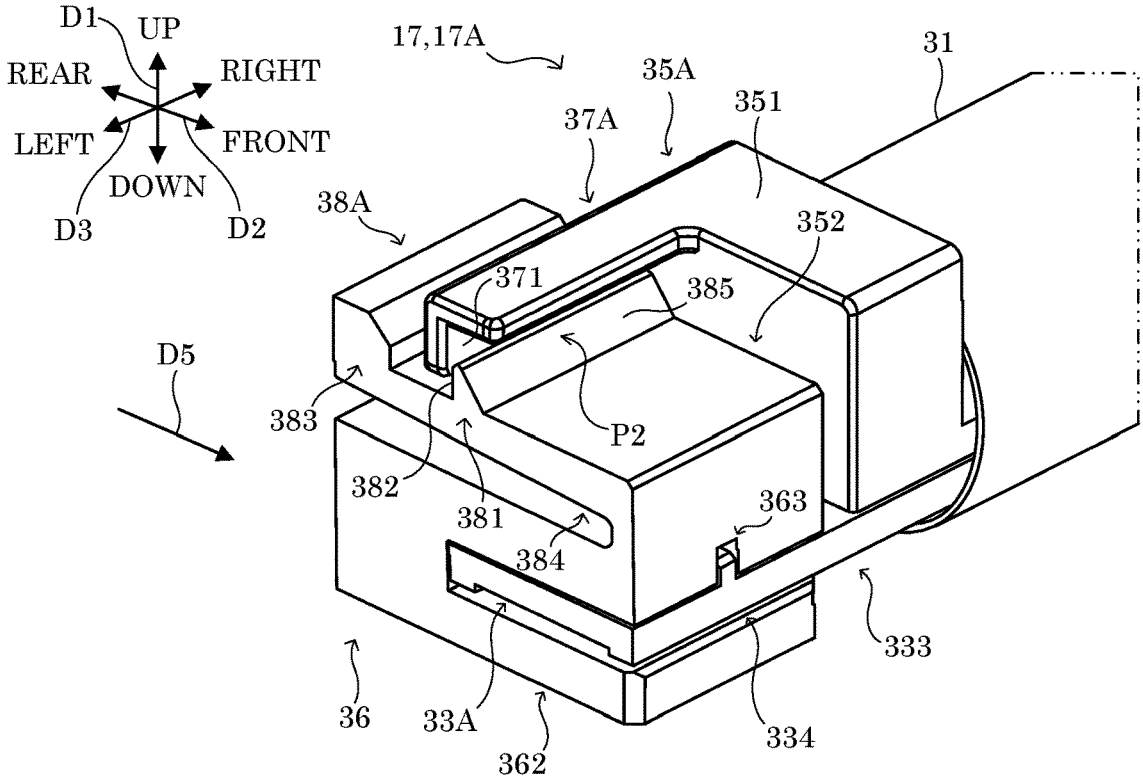
FIG. 8 is a diagram showing another modification of the fixing device according to the first embodiment of the present disclosure.

Next, with reference to FIG. 2 to FIG. 8, a description is given of a configuration of a fixing device 17A according to a first embodiment of the present disclosure. Here, FIG. 2 is a cross-sectional diagram showing a configuration of the fixing device 17A. FIG. 3 is a perspective diagram showing a configuration of a left end portion of a fixing device 17X that does not belong to the embodiments of the present disclosure. FIG. 4 is a plan diagram showing a configuration of a connector 36 of the fixing device 17X. FIG. 5 is a perspective diagram showing a configuration of a left end portion of the fixing device 17A. FIG. 6 is a plan diagram showing a configuration of the connector 36 of the fixing device 17A. FIG. 7 and FIG. 8 are perspective diagrams showing configurations of modifications of the fixing device 17A. It is noted that a one-dot chain line in FIG. 6 indicates a plane F1 that includes the center of the connector 36 attached to a heater support member 33A, in the width direction of a fixing belt 31.

As shown in FIG. 2 and FIG. 5, the fixing device 17A includes the fixing belt 31, a heater 32, the heater support member 33A, a pressing member 34, a belt guide member 35A, the connector 36, an engaging portion 37A, a hook portion 38A, and a pressure roller 51.

The fixing belt 31 is flexible and has an endless shape. As shown in FIG. 2, the fixing belt 31 is held between the heater 32 and the pressure roller 51 and rotates following the rotation of the pressure roller 51. The fixing belt 31 is guided to move along the moving path by a guide portion 332 (see FIG. 2) of the heater support member 33A and a guide portion 351 of the belt guide member 35A. The fixing belt 31, in a state of being heated by the heater 32, comes in contact with a sheet to which a toner image has been transferred, thereby fixing the toner image to the sheet.

As shown in FIG. 2, the heater 32 is provided in contact with an inner peripheral surface of the fixing belt 31, and heats the fixing belt 31 from an inner side of the fixing belt 31. The heater 32 is formed in a shape of a flat plate elongated in the left-right direction D3 that is a width direction of the fixing belt 31, and a left end portion of the heater 32 is exposed to outside the fixing belt 31. For example, the heater 32 includes a substrate, a resistance heating element, four electrodes 322 (see FIG. 11), a wiring pattern, and a protection layer.

The substrate is elongated in the left-right direction D3. The resistance heating element is provided on a surface of the substrate on the pressure roller 51 side. The four electrodes 322 are provided on the surface of the substrate on the pressure roller 51 side and connected to the connector 36. The four electrodes 322 are provided on the left end portion of the heater 32 that is exposed to outside the fixing belt 31. The wiring pattern is provided on the surface of the substrate on the pressure roller 51 side and electrically connects the resistance heating element with the four electrodes 322. The protection layer protects the resistance heating element, the four electrodes 322, and the wiring pattern. An outer surface of the protection layer constitutes a contact surface 321 (see FIG. 2) of the heater 32 that is in contact with the fixing belt 31. It is noted that the present disclosure may be applied to a fixing device that includes a heater that heats the fixing belt 31 from the inner side of the fixing belt 31, without contacting the inner peripheral surface of the fixing belt 31. In addition, the present disclosure may be applied to a fixing device that includes a heater that heats the fixing belt 31 from an outer side of the fixing belt 31.

As shown in FIG. 2, the heater support member 33A supports the heater 32 by contacting a surface of the heater 32 opposite from the contact surface 321. The heater support member 33A is formed to be elongated in the left-right direction D3 that is the width direction of the fixing belt 31, and as shown in FIG. 5, the left end portion of the heater support member 33A is exposed to outside the fixing belt 31. As shown in FIG. 2, the heater support member 33A has a recessed portion 331 in which the heater 32 is stored. The heater 32, in a state of being stored in the recessed portion 331, is supported by a bottom surface of the recessed portion 331. In the state where the heater 32 is stored in the recessed portion 331, the contact surface 321 of the heater 32 is located more inside the recessed portion 331 than the edge of the recessed portion 331 (see FIG. 15). It is noted that, in the state where the heater 32 is stored in the recessed portion 331, the contact surface 321 of the heater 32 may be flush with the edge of the recessed portion 331.

As shown in FIG. 2, guide portions 332 are provided at opposite ends of the heater support member 33A in the front-rear direction D2. The guide portions 332 guide the fixing belt 31 to move along the moving path by contacting the inner peripheral surface of the fixing belt 31. In addition, as shown in FIG. 5, an attached portion 334 is provided in an exposed portion 333 of the heater support member 33A, wherein the exposed portion 333 is exposed to outside the fixing belt 31, and the connector 36 is attached to the attached portion 334. The attached portion 334 includes a rail that guides the connector 36 in an attachment direction D5 (see FIG. 5). The heater 32 and the heater support member 33A are an example of a heating portion of the present disclosure.

As shown in FIG. 2, the pressing member 34 is provided on an upper surface of the heater support member 33A, and presses the heater 32 supported by the heater support member 33A, and the fixing belt 31 toward the pressure roller 51. The pressing member 34 is formed to be elongated in the left-right direction D3 that is the width direction of the fixing belt 31, and an end portion of the pressing member 34 in the longitudinal direction is coupled with the belt guide member 35A.

As shown in FIG. 5, the belt guide member 35A includes the guide portion 351. The guide portion 351 is supported by a side plate (not shown) provided outside the fixing belt 31 in the left-right direction D3, and guides the fixing belt 31 to move along the moving path. Specifically, the guide portion 351 is supported by the side plate so as to be movable in the up-down direction D1. In addition, the guide portion 351 includes a guide piece 353 (see FIG. 14) that extends toward the inside of the fixing belt 31 in the left-right direction D3 to come in contact with the inner peripheral surface of the fixing belt 31. The fixing belt 31 is guided to move along the moving path by the guide piece 353.

As shown in FIG. 5, the guide portion 351 includes a coupling portion 352. The coupling portion 352 is formed such that an end portion of the pressing member 34 in its longitudinal direction can be inserted in the coupling portion 352 (see FIG. 10). The pressing member 34 is coupled with the belt guide member 35A when the end portion of the pressing member 34 in its longitudinal direction is inserted in the coupling portion 352. The guide portion 351 is biased toward the pressure roller 51 by a biasing member (not shown). Upon being coupled with the belt guide member 35A and receiving a biasing force from the biasing member via the belt guide member 35A, the pressing member 34 presses the heater 32 supported by the heater support member 33A, and the fixing belt 31 toward the pressure roller 51.

The connector 36 electrically connects four cables 361 (see FIG. 6) that are connected to a power supply (not shown), with the heater 32. The connector 36 is attached to the attached portion 334 of the heater support member 33A in the attachment direction D5 shown in FIG. 5. Here, the attachment direction D5 is perpendicular to the left-right direction D3 that is the width direction of the fixing belt 31. For example, the attachment direction D5 is a directed from the rear to the front of the image forming apparatus 100. Specifically, as shown in FIG. 5, the connector 36 includes an attachment portion 362 that forms a storage space to store the attached portion 334 therein by vertically holding it from the rear side of the image forming apparatus 100. At an upper surface of the storage space, a groove portion 363 is formed to extend in the attachment direction D5. The rail of the attached portion 334 is inserted in the groove portion 363. At a lower surface of the storage space, four contacts 364 (see FIG. 6) are provided, wherein the four contacts 364 correspond to the four cables 361 respectively. In the state where the connector 36 is attached to the attached portion 334, the four contacts 364 come in contact with the four electrodes 322 of the heater 32, thereby electrically connecting the four electrodes 322 with the four cables 361.

As shown in FIG. 2, the pressure roller 51 is provided to face the contact surface 321 of the heater 32 across the fixing belt 31, and press the fixing belt 31. The length of the pressure roller 51 in its axial direction is shorter than the length of the fixing belt 31 in its width direction, and the pressure roller 51 is disposed such that opposite ends thereof in the axial direction are located inside of the pressure roller 51. The pressure roller 51 includes a shaft portion 511 and an elastic layer 512, wherein the shaft portion 511 is made of a metal, and the elastic layer 512 is elastic and formed on the outer peripheral of the shaft portion 511. As a result, the fixing belt 31 that is pressed toward the pressure roller 51 by the pressing member 34, is pressed against the pressure roller 51. The pressure roller 51 rotates upon receiving a rotational driving force supplied from a motor (not shown).

Here, FIG. 3 shows the fixing device 17X that does not belong to the embodiments of the present disclosure. The fixing device 17X has the same configuration as the fixing device 17A except that it includes an engaging portion 37X and a hook portion 38X instead of the engaging portion 37A and the hook portion 38A.

As shown in FIG. 3, the engaging portion 37X is provided in the belt guide member 35A. Specifically, the engaging portion 37X is provided to project from the guide portion 351 outward in the width direction of the fixing belt 31. In addition, the hook portion 38X is provided at a right end portion of an upper surface of the connector 36. The engaging portion 37X is engaged with the hook portion 38X, thereby restricting the connector 36 from moving in an opposite direction to the attachment direction D5. This prevents the connector 36 attached to the heater support member 33A from being removed from the heater support member 33A.

However, in the fixing device 17X, the engaging portion 37X and the hook portion 38X are engaged with each other at an engagement position P1 (see FIG. 3) where the engaging portion 37X intersects with a plane that is vertical in the left-right direction D3 and includes a contact 364 that is located at the most right side in the connector 36 attached to the heater support member 33A. As a result, as shown in FIG. 4, if, for example, pulling of the cables 361 applies a force to the connector 36 in an opposite direction to the attachment direction D5, and the connector 36 pivots around the engagement position P1, a movement amount of a contact 364 that is located at the most left side in the connector 36 increases. This makes an electric connection state between the heater 32 and the connector 36 unstable.

On the other hand, as described below, the fixing device 17A is configured to restrict the electric connection state between the heater 32 and the connector 36 from becoming unstable.

As shown in FIG. 5, the engaging portion 37A is provided in the belt guide member 35A. Specifically, the engaging portion 37A is provided to project from the guide portion 351 outward in the width direction of the fixing belt 31. The engaging portion 37A is engaged with the connector 36 at an engagement position P2 (see FIG. 5 and FIG. 6) that intersects with a plane F1 (see FIG. 6) that is vertical in the left-right direction D3 and includes a center of the connector 36 attached to the heater support member 33A in the width direction of the fixing belt 31 (the left-right direction D3). Specifically, the engaging portion 37A is provided to project leftward from the left side of the guide portion 351 to beyond the engagement position P2.

The hook portion 38A is engaged with the engaging portion 37A in the state where the connector 36 is attached to the attached portion 334 of the heater support member 33A. As shown in FIG. 5 and FIG. 6, the hook portion 38A is provided at a center of the upper surface of the connector 36 in the left-right direction D3. The hook portion 38A includes a first claw portion 381, a second claw portion 383, and a support portion 384.

As shown in FIG. 5, the support portion 384 is provided to extend upward from a tip end portion of the upper surface of the connector 36 in the attachment direction D5, and further extend from an end of the extension in a direction opposite to the attachment direction D5. The support portion 384 supports the first claw portion 381 and the second claw portion 383 such that they can pivot in the up-down direction D1 (an example of a pivot direction of the present disclosure).

As shown in FIG. 5, the first claw portion 381 is provided to project upward from an upper surface of the support portion 384. The first claw portion 381 is engaged with the engaging portion 37A in a state where the connector 36 is attached to the heater support member 33A. The first claw portion 381 is an example of an engaged portion of the present disclosure.

In the fixing device 17A, the engaging portion 37A and the first claw portion 381 of the hook portion 38A are engaged with each other at the engagement position P2 that intersects with the plane F1 that includes the center of the connector 36 attached to the heater support member 33A in the width direction of the fixing belt 31 (the left-right direction D3). As a result, compared to the fixing device 17X, if, for example, pulling of the cables 361 applies a force to the connector 36 in an opposite direction to the attachment direction D5, and the connector 36 pivots around the engagement position P2, movement amounts of the contacts 364 are restricted (see FIG. 6). Accordingly, it is possible to restrict an electric connection state between the heater 32 and the connector 36 from becoming unstable.

Here, the engaging portion 37A includes an engaging surface 371 that is parallel to a plane perpendicular to the attachment direction D5, and includes the engagement position P2. The engaging surface 371 extends from the left side of the guide portion 351 leftward to beyond the engagement position P2.

In addition, the first claw portion 381 includes an engaged surface 382 that is parallel to a plane perpendicular to the attachment direction D5, and is engaged with the engaging surface 371 of the engaging portion 37A in the state where the connector 36 is attached to the heater support member 33A. Specifically, the engaged surface 382 is a side surface of the first claw portion 381 on the upstream side in the attachment direction D5.

In the fixing device 17A, the engaging surface 371 and the engaged surface 382 that are both parallel to a plane perpendicular to the attachment direction D5, are engaged with each other. As a result, compared to a configuration where the engaging portion 37A and the hook portion 38A come in point contact with each other, if, for example, pulling of the cables 361 applies a force to the connector 36 in an opposite direction to the attachment direction D5, it is possible to restrict the connector 36 from pivoting around the engagement position P2. It is noted that either or both of the engaging surface 371 and the engaged surface 382 may not be parallel to a plane perpendicular to the attachment direction D5.

The first claw portion 381 includes an inclined surface 385 that, when the connector 36 is attached to the heater support member 33A, comes in contact with the engaging portion 37A, thereby causing the first claw portion 381 to retreat from the engaging portion 37A in the up-down direction D1. As shown in FIG. 5, the inclined surface 385 is a side surface of the first claw portion 381 located on the downstream side in the attachment direction D5. With this configuration, when a worker attaches the connector 36 to the heater support member 33A, the worker does not need to push down the first claw portion 381 to prevent the first claw portion 381 from contacting the back end portion of the engaging portion 37A. It is noted that the first claw portion 381 may not include the inclined surface 385.

The second claw portion 383 is provided to project upward from the upper surface of the support portion 384 at a position on the upstream side of the first claw portion 381 in the attachment direction D5. In the state where the connector 36 is attached to the attached portion 334 of the heater support member 33A, the second claw portion 383 faces a surface of the engaging portion 37A opposite from the engaging surface 371. It is noted that the hook portion 38A may not include the second claw portion 383.

Here, FIG. 7 shows a first modification of the fixing device 17A. In the fixing device 17A shown in FIG. 7, the first claw portion 381 and the second claw portion 383 are formed to extend between opposite ends of the connector 36 in the left-right direction D3. In addition, the engaged surface 382 is formed to extend between opposite ends of the connector 36 in the left-right direction D3. In addition, the engaging surface 371 of the engaging portion 37A is formed to face the entire region of the engaged surface 382 in the left-right direction D3. In the configuration shown in FIG. 7, even in a case where a force is applied to the connector 36 in a direction opposite to the attachment direction D5, the connector 36 does not pivot. Accordingly, the electric connection state between the heater 32 and the connector 36 does not become unstable.

In addition, FIG. 8 shows a second modification of the fixing device 17A. In the fixing device 17A shown in FIG. 8, the first claw portion 381, the second claw portion 383, and the support portion 384 are formed to extend between opposite ends of the connector 36 in the left-right direction D3. With the configuration shown in FIG. 8 where the support portion 384 has the same width as the first claw portion 381 and the second claw portion 383, it is possible to improve the durability of the hook portion 38A.

Figure 9:
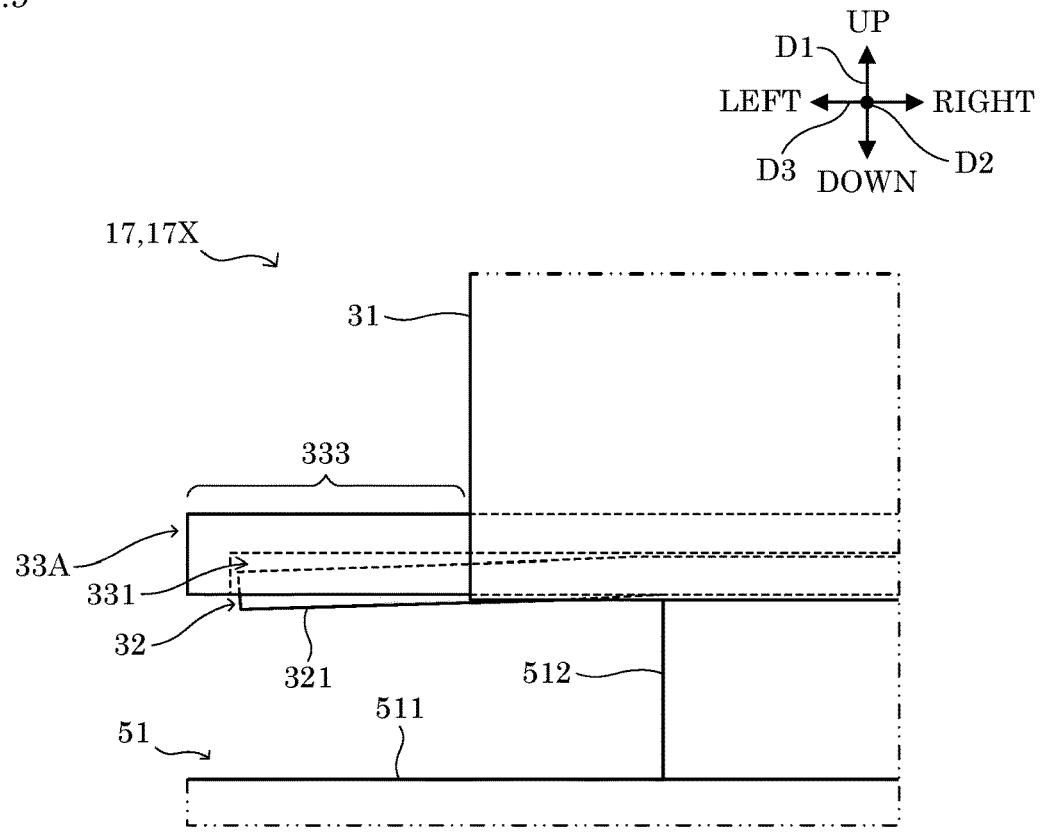
FIG. 9 is a diagram showing a configuration of the fixing device that does not belong to the embodiments of the present disclosure.

Meanwhile, as shown in FIG. 9, when, as in the fixing device 17X, opposite ends of the pressure roller 51 in its axial direction correspond to the inner region of the fixing belt 31, an end portion of the heater 32 located outside the fixing belt 31 may be bent toward the pressure roller 51 when the fixing belt 31 and the heater 32 are pressed by the pressure roller 51. When this happens, a corner of the bent portion of the heater 32 may contact the fixing belt 31 and damage the fixing belt 31. To avoid this, the heater 32 may be fixed to the heater support member 33A by a fixation member such as double-sided tape, to restrict the heater 32 from bending. However, in this case, the fixation member is required.

On the other hand, as described below, a fixing device 17B according to a second embodiment of the present disclosure, and a fixing device 17C according to a third embodiment of the present disclosure, are configured to restrict the heater 32 from being bent toward the pressure roller 51, without using a fixation member.

Second Embodiment

Figure 10:
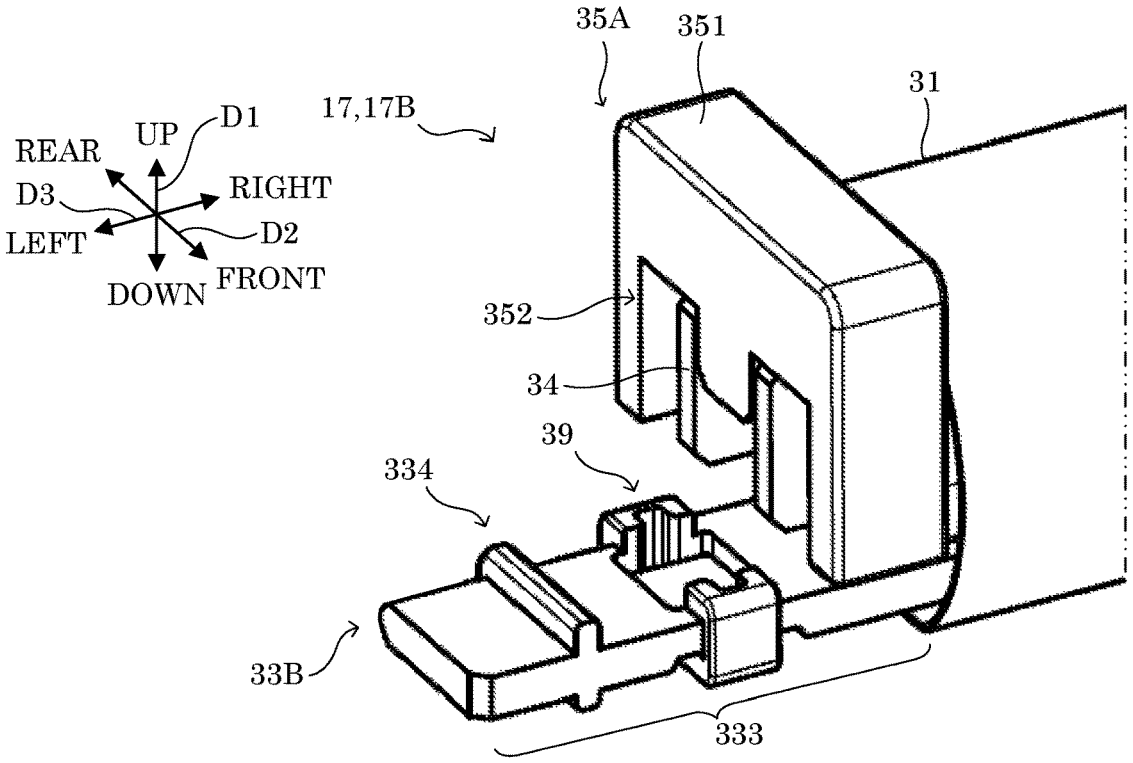
FIG. 10 is a diagram showing a configuration of a fixing device according to a second embodiment of the present disclosure.
Figure 11:
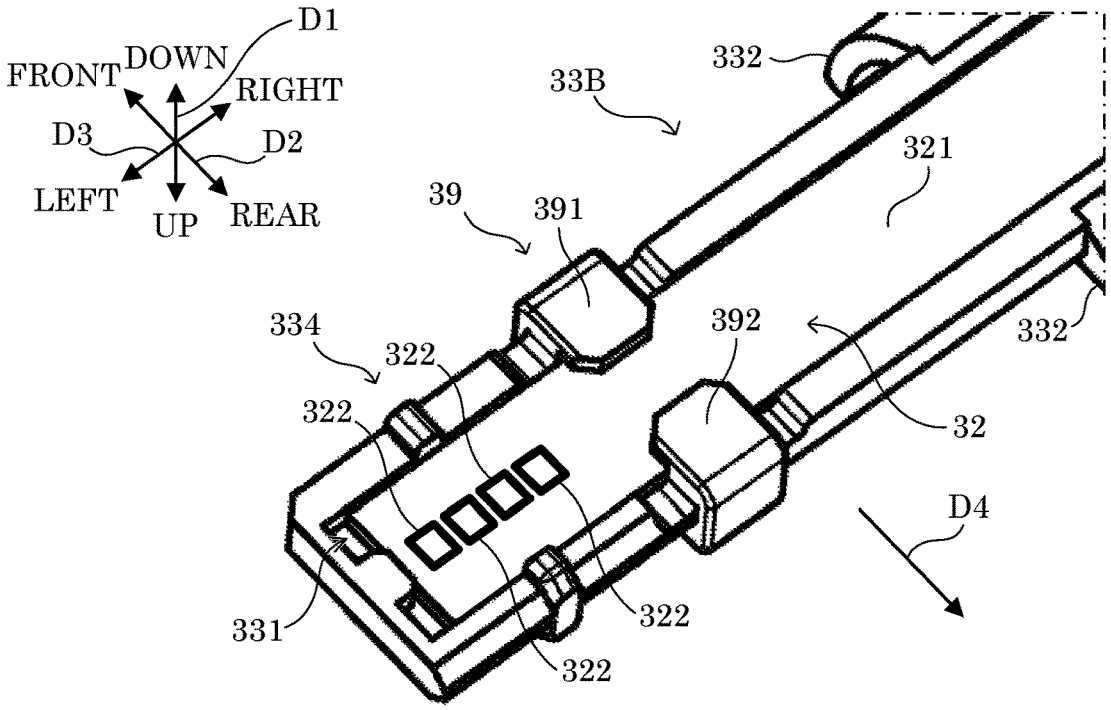
FIG. 11 is a diagram showing a configuration of a heater and a heater support member of the fixing device according to the second embodiment of the present disclosure.
Figure 12:
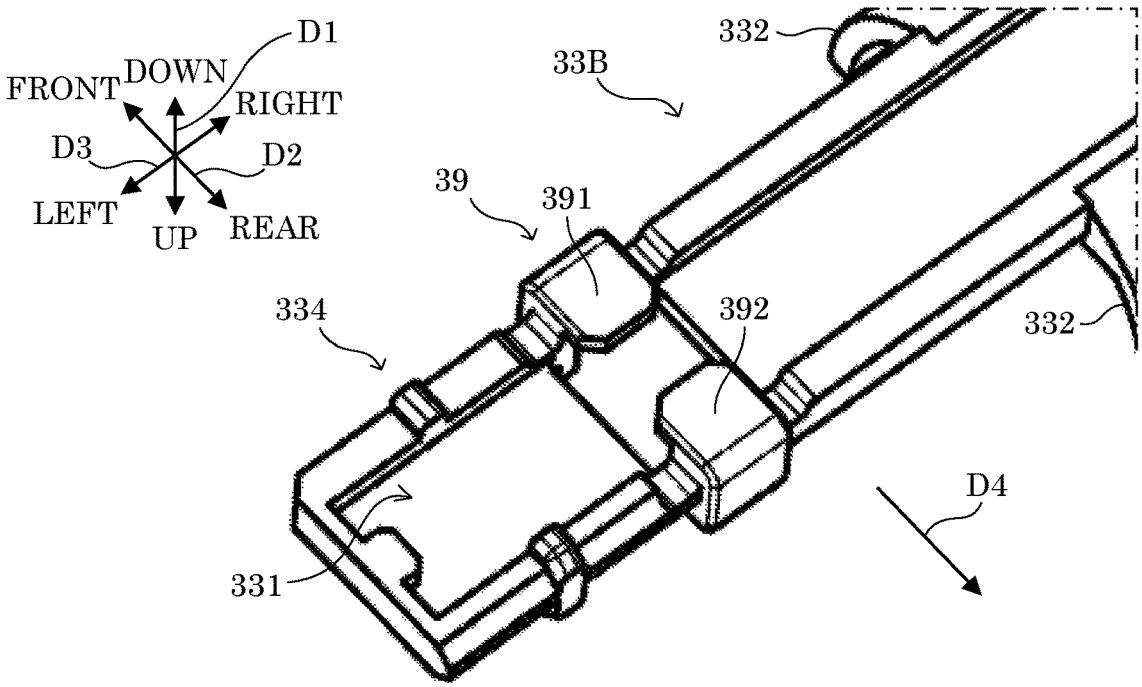
FIG. 12 is a diagram showing a configuration of the heater support member of the fixing device according to the second embodiment of the present disclosure.

Next, a description is given of the fixing device 17B according to a second embodiment of the present disclosure, with reference to FIG. 10 to FIG. 12. Here, FIG. 10 is a perspective diagram showing a configuration of a part of a left end portion of the fixing device 17B. FIG. 11 is a perspective diagram showing configurations of the heater 32 and a heater support member 33B. FIG. 12 is a perspective diagram showing a configuration of the heater support member 33B.

The fixing device 17B has the same configuration as the fixing device 17A except that it includes a heater support member 33B instead of the heater support member 33A.

As shown in FIG. 10, the heater support member 33B has the same configuration as the heater support member 33A except that it includes a restriction portion 39 shown in FIG. 10 to FIG. 12.

As shown in FIG. 10, the restriction portion 39 is provided on the exposed portion 333 of the heater support member 33B. Specifically, the restriction portion 39 is provided on the exposed portion 333 to be closer to the fixing belt 31 than the attached portion 334. As shown in FIG. 12, the restriction portion 39 includes a first restriction piece 391 and a second restriction piece 392. In the heater support member 33B, the first restriction piece 391 and the second restriction piece 392 are disposed at the same position in the left-right direction D3.

The first restriction piece 391 is provided to extend from an edge portion of the recessed portion 331 on the upstream side in the sheet conveyance direction D4 toward the downstream side in the conveyance direction D4. As shown in FIG. 11, the first restriction piece 391 faces an upstream side, in the conveyance direction D4, of the contact surface 321 of the heater 32 stored in the recessed portion 331. A gap with a distance that slightly exceeds the thickness of the heater 32 is provided between the first restriction piece 391 and the bottom surface of the recessed portion 331.

The second restriction piece 392 is provided to extend from an edge portion of the recessed portion 331 on the downstream side in the sheet conveyance direction D4 toward the upstream side in the conveyance direction D4. As shown in FIG. 11, the second restriction piece 392 faces a downstream side, in the conveyance direction D4, of the contact surface 321 of the heater 32 stored in the recessed portion 331. A gap with a distance that slightly exceeds the thickness of the heater 32 is provided between the second restriction piece 392 and the bottom surface of the recessed portion 331.

In the fixing device 17B, the first restriction piece 391 and the second restriction piece 392 restrict the contact surface 321 of the heater 32 from moving toward the pressure roller 51, outside the fixing belt 31 in the left-right direction D3 that is the width direction of the fixing belt 31. As a result, it is possible to restrict the heater 32 from bending toward the pressure roller 51, without using the fixation member.

It is noted that the restriction portion 39 may include only one of the first restriction piece 391 and the second restriction piece 392. In addition, the restriction portion 39 may not include any of the first restriction piece 391 and the second restriction piece 392. Specifically, the restriction portion 39 may be stretched between an upstream edge portion and a downstream edge portion of the recessed portion 331 in the sheet conveyance direction D4. In addition, the restriction portion 39 may be provided on the exposed portion 333 to be closer to an end thereof opposite to the fixing belt 31 than the attached portion 334.

Third Embodiment

Figure 13:
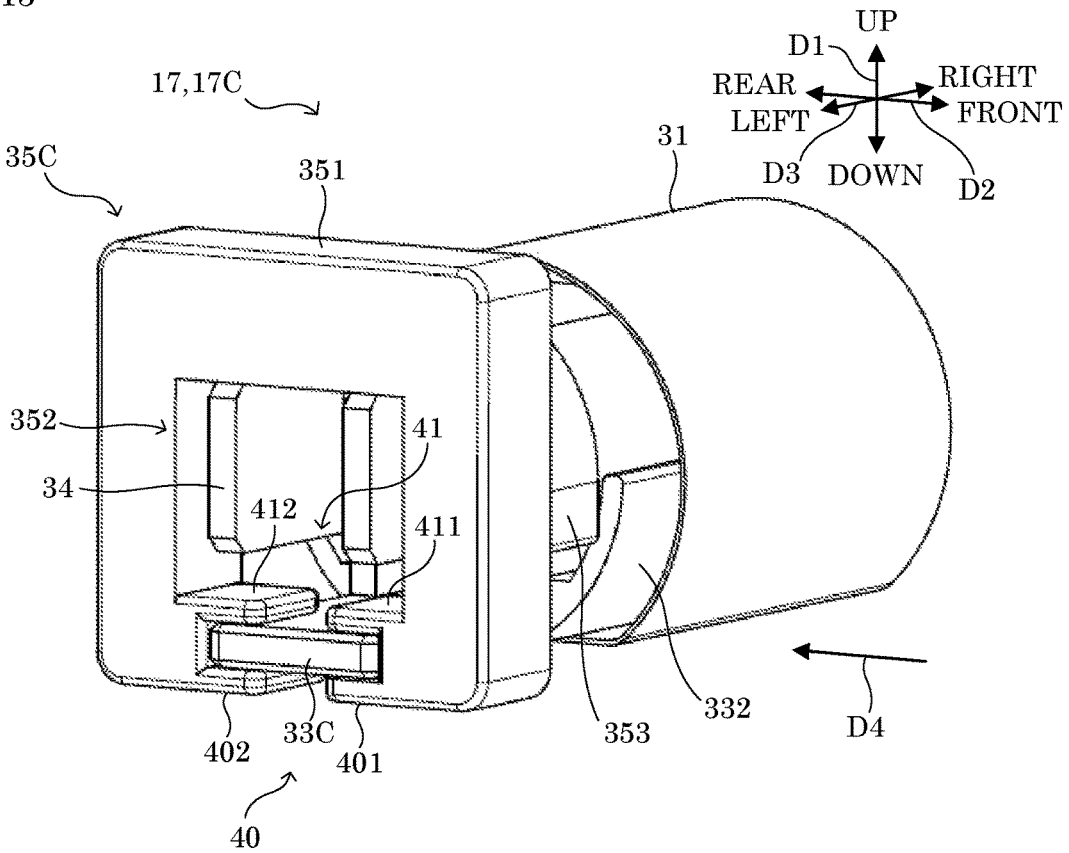
FIG. 13 is a diagram showing a configuration of a fixing device according to a third embodiment of the present disclosure.
Figure 14:
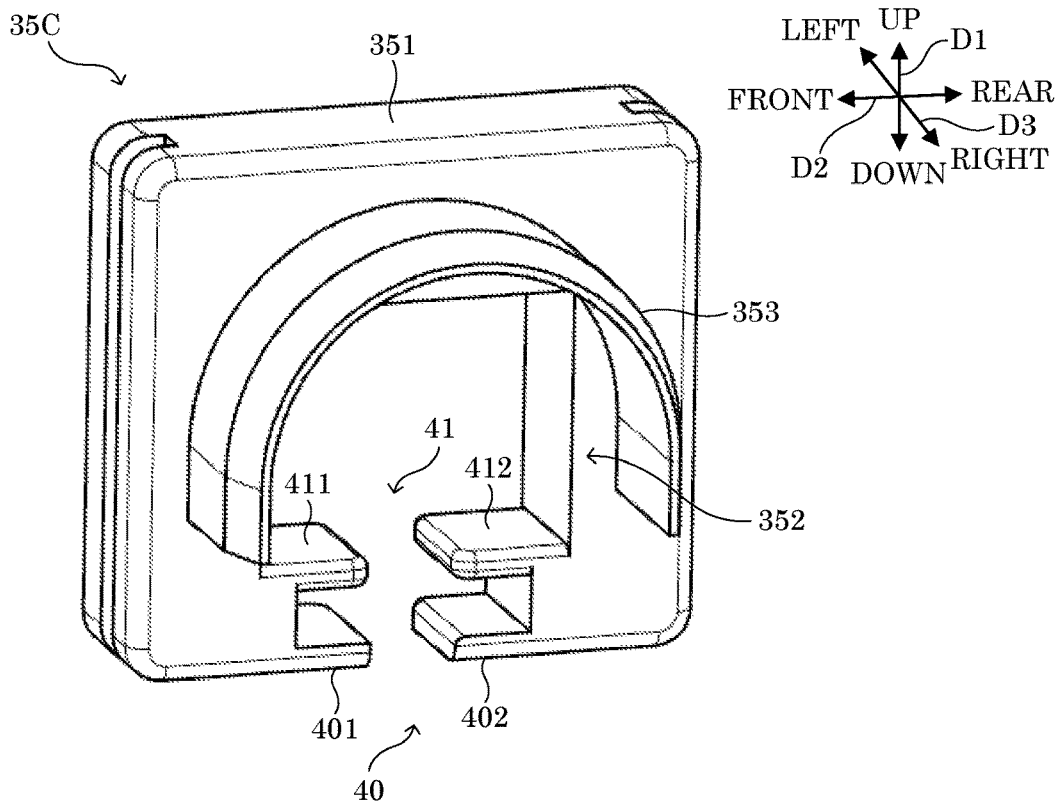
FIG. 14 is a diagram showing a configuration of a belt guide member of the fixing device according to the third embodiment of the present disclosure.
Figure 15:
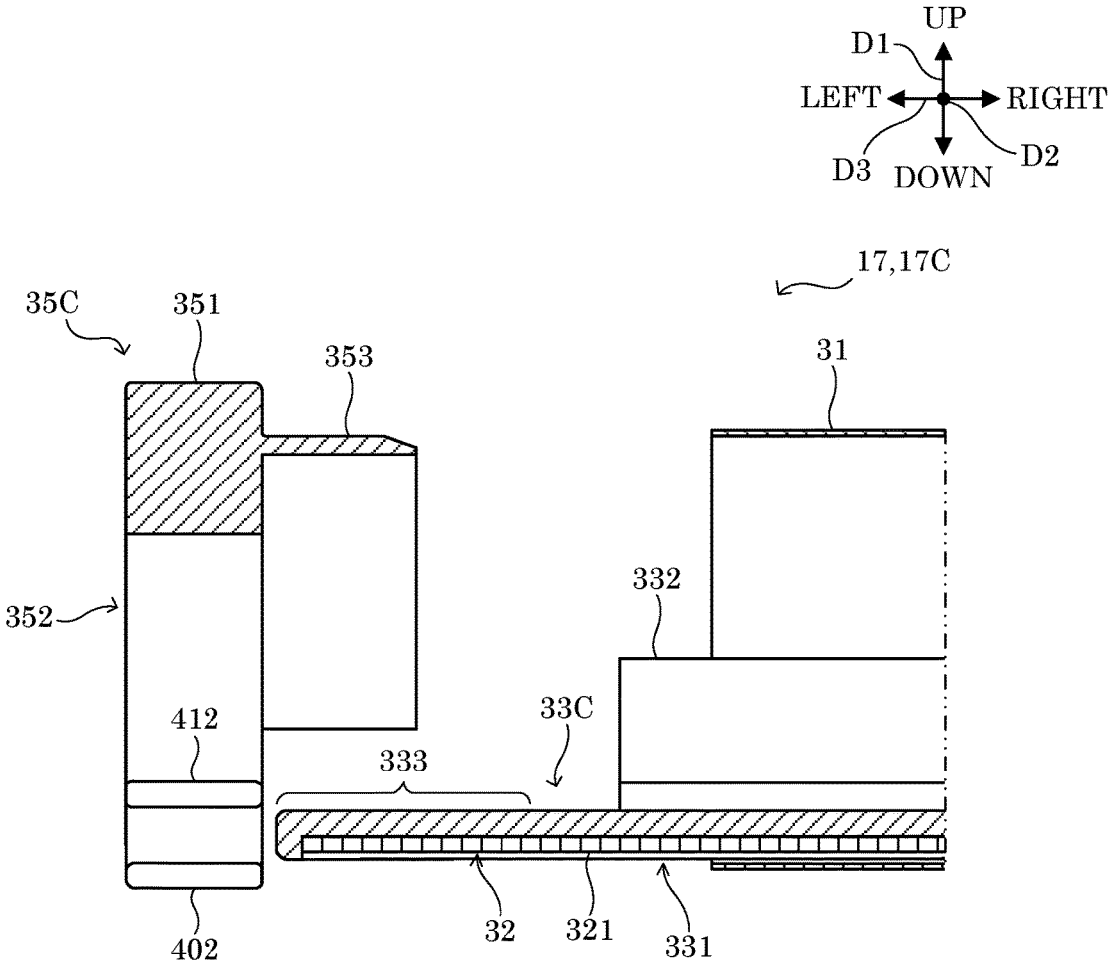
FIG. 15 is a diagram showing a configuration of the fixing device according to the third embodiment of the present disclosure.

Next, a description is given of a configuration of the fixing device 17C according to the third embodiment of the present disclosure, with reference to FIG. 13 to FIG. 15. Here, FIG. 13 is a perspective diagram showing a configuration of part of a left end portion of the fixing device 17C. FIG. 14 is a perspective diagram showing a configuration of a belt guide member 35C. FIG. 15 is a cross-sectional diagram showing a configuration of a part of the left end portion of the fixing device 17C.

The fixing device 17C has the same configuration as the fixing device 17A except that it includes a heater support member 33C instead of the heater support member 33A, and that it includes a belt guide member 35C instead of the belt guide member 35A.

The belt guide member 35C has the same configuration as the belt guide member 35A except that it includes a restriction portion 40 and a support portion 41 shown in FIG. 13 and FIG. 14.

As shown in FIG. 13, the restriction portion 40 is provided in a lower portion of the belt guide member 35C. The restriction portion 40 is provided to face the contact surface 321 of the heater 32 stored in the recessed portion 331 of the heater support member 33C. As shown in FIG. 13 and FIG. 14, the restriction portion 40 includes a first restriction piece 401 and a second restriction piece 402.

The first restriction piece 401 is provided to project from the upstream side toward the downstream side in the sheet conveyance direction D4. The first restriction piece 401 faces an upstream side, in the conveyance direction D4, of the contact surface 321 of the heater 32 stored in the recessed portion 331.

The second restriction piece 402 is provided to project from the downstream side toward the upstream side in the sheet conveyance direction D4. The second restriction piece 402 faces a downstream side, in the conveyance direction D4, of the contact surface 321 of the heater 32 stored in the recessed portion 331.

In the fixing device 17C, the first restriction piece 401 and the second restriction piece 402 restrict the contact surface 321 of the heater 32 from moving toward the pressure roller 51, outside the fixing belt 31 in the left-right direction D3 that is the width direction of the fixing belt 31. As a result, it is possible to restrict the heater 32 from bending toward the pressure roller 51, without using the fixation member.

As shown in FIG. 13, the support portion 41 is provided above the restriction portion 40 in the belt guide member 35C. As shown in FIG. 13 and FIG. 14, the support portion 41 includes a first support piece 411 and a second support piece 412.

The first support piece 411 is provided to project from the upstream side toward the downstream side in the conveyance direction D4. The first support piece 411 is provided to face the first restriction piece 401 across the heater support member 33C. A gap with a distance that slightly exceeds the thickness of the heater support member 33C is provided between the first restriction piece 401 and the first support piece 411.

The second support piece 412 is provided to project from the downstream side toward the upstream side in the conveyance direction D4. The second support piece 412 is provided to face the second restriction piece 402 across the heater support member 33C. A gap with a distance that slightly exceeds the thickness of the heater support member 33C is provided between the second restriction piece 402 and the second support piece 412.

The heater support member 33C has the same configuration as the heater support member 33A except that it does not include the attached portion 334.

As shown in FIG. 15, the heater support member 33C is formed such that the exposed portion 333 that is exposed to outside the fixing belt 31 can be inserted between the restriction portion 40 and the support portion 41.

In the fixing device 17C, an upper surface of the heater support member 33C is supported by the first support piece 411 and the second support piece 412. This regulates position relationship between the contact surface 321 of the heater 32 stored in the heater support member 33C and the restriction portion 40, thereby preventing the restriction position of the restriction portion 40 from being varied when, for example, the attachment position of the belt guide member 35C is varied. In addition, in the fixing device 17C, the exposed portion 333 of the heater support member 33C is formed to be inserted between the restriction portion 40 and the support portion 41. As a result, it is possible to easily mount the belt guide member 35C to the heater support member 33C by inserting the exposed portion 333 of the heater support member 33C in which the fixing belt 31, the heater 32, and the pressing member 34 have been assembled, between the restriction portion 40 and the support portion 41.

It is noted that the restriction portion 40 may include only one of the first restriction piece 401 and the second restriction piece 402. In addition, the restriction portion 40 may not include any of the first restriction piece 401 and the second restriction piece 402. Specifically, the restriction portion 40 may be formed to face the entire region of the contact surface 321 of the heater 32 in the conveyance direction D4. In addition, the belt guide member 35C may not include the support portion 41. In this case, the heater support member 33C may include the attached portion 334.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing belt;

a heating portion configured to heat the fixing belt; and a belt guide member including a guide portion and an engaging portion, wherein the guide portion is configured to guide the fixing belt to move along a moving path, the engaging portion projects from the guide portion outward in a width direction of the fixing belt, the engaging portion is configured to engage with a connector at an engagement position that intersects with a plane that includes a center, in the width direction, of the connector attached to the heating portion in an attachment direction perpendicular to the width direction, the connector includes an engaged portion configured to engage with the engaging portion, the engaging portion includes an engaging surface that is parallel to a plane perpendicular to the attachment direction, the engaging surface including the engagement position, the engaged portion includes an engaged surface that is parallel to a plane perpendicular to the attachment direction, the engaged surface being configured to engage with the engaging surface, the engaged surface is elongated in the width direction, and the engaging surface faces an entire region of the engaged surface in the width direction.

2. The fixing device according to claim 1, wherein the connector further includes a support portion that supports the engaged portion such that the engaged portion can pivot in a pivot direction perpendicular to both of the width direction and the attachment direction, with a tip end portion of the connector extending in the attachment direction as a fulcrum.

3. The fixing device according to claim 2, wherein the support portion is the same as the engaged portion in length in the width direction.

4. The fixing device according to claim 2, wherein the engaged portion includes an inclined surface that, when the connector is attached to the heating portion, comes in contact with the engaging portion, thereby causing the engaged portion to retreat from the engaging portion in the pivot direction.

5. An image forming apparatus configured to form an image on a sheet by using the fixing device according to claim 1.

6. A fixing device comprising:

a fixing belt;

a heating portion configured to heat the fixing belt; and a belt guide member including a guide portion and an engaging portion, wherein the guide portion is configured to guide the fixing belt to move along a moving path, the engaging portion projects from the guide portion outward in a width direction of the fixing belt, the engaging portion is configured to engage with a connector at an engagement position that intersects with a plane that includes a center, in the width direction, of the connector attached to the heating portion in an attachment direction perpendicular to the width direction, the connector includes an engaged portion configured to engage with the engaging portion, and a support portion that supports the engaged portion such that the engaged portion can pivot in a pivot direction perpendicular to both of the width direction and the attachment direction, with a tip end portion of the connector extending in the attachment direction as a fulcrum, the engaging portion includes an engaging surface that is parallel to a plane perpendicular to the attachment direction, the engaging surface including the engagement position, the engaged portion includes an engaged surface that is parallel to a plane perpendicular to the attachment direction, the engaged surface being configured to engage with the engaging surface.

7. The fixing device according to claim 6, wherein the support portion is the same as the engaged portion in length in the width direction.

8. The fixing device according to claim 6, wherein the engaged portion includes an inclined surface that, when the connector is attached to the heating portion, comes in contact with the engaging portion, thereby causing the engaged portion to retreat from the engaging portion in the pivot direction.

9. An image forming apparatus configured to form an image on a sheet by using the fixing device according to claim 6.

* * * * *